US011118798B2

(12) United States Patent
Brubaker et al.

(10) Patent No.: US 11,118,798 B2
(45) Date of Patent: Sep. 14, 2021

(54) COMPOSITE ROOF STRUCTURE FOR AIR HANDLING UNITS

(71) Applicant: JOHNSON CONTROLS TECHNOLOGY COMPANY, Auburn Hills, MI (US)

(72) Inventors: Merle R. Brubaker, York, PA (US); Robert A. Amick, York, PA (US); Henry L. Urey, Windsor, PA (US); Karen M. Brenner, Dallastown, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/565,024

(22) Filed: Sep. 9, 2019

(65) Prior Publication Data

US 2020/0284447 A1 Sep. 10, 2020

Related U.S. Application Data

(60) Provisional application No. 62/815,855, filed on Mar. 8, 2019.

(51) Int. Cl.
*E04B 7/22* (2006.01)
*F24F 1/58* (2011.01)

(52) U.S. Cl.
CPC ..... *F24F 1/58* (2013.01); *E04B 7/22* (2013.01); *E04B 7/225* (2013.01)

(58) Field of Classification Search
CPC ..... E04B 7/22; E04B 7/225; E04B 1/34321; E04B 1/3483; E04B 1/7654
See application file for complete search history.

(56) References Cited

U.S. PATENT DOCUMENTS 3,971,184 A * 7/1976 Van Wagoner ..... E04D 3/352 428/201
4,063,395 A * 12/1977 Stewart ..... E04B 7/00 52/309.5
4,318,261 A * 3/1982 Smith ..... E04B 7/22 52/475.1
4,385,474 A * 5/1983 Earley ..... E04D 13/1606 52/3
4,642,950 A * 2/1987 Kelly ..... E04D 11/02 52/90.2
4,738,067 A * 4/1988 Froseth ..... E04D 3/354 52/478
5,307,849 A * 5/1994 Nelson ..... F24F 1/56 150/165
5,519,971 A * 5/1996 Ramirez ..... E04C 2/288 52/220.2
6,442,904 B1 * 9/2002 Ortiz ..... E04D 13/0725 52/11
7,935,202 B2 5/2011 Stanley
8,156,700 B2 4/2012 Umlor
8,316,617 B2 11/2012 Krovats
(Continued)

OTHER PUBLICATIONS

Annexair AHU "Tomorrow's Airflow" as viewed on Sep. 9, 2019.

*Primary Examiner* — Paola Agudelo
(74) *Attorney, Agent, or Firm* — Fletcher Yoder, P.C,

(57) ABSTRACT

A cover for an air handling unit enclosure. The cover may include a panel defining a first surface, an insulating layer connected to the first surface of the panel via a first adhesive, and a waterproof membrane connected to the insulating layer via a second adhesive.

25 Claims, 6 Drawing Sheets

(56) References Cited

U.S. PATENT DOCUMENTS

| | | | | |
|---|---|---|---|---|
| 8,567,144 | B2 * | 10/2013 | Kelly | E04D 13/1643 52/409 |
| 8,635,827 | B2 | 1/2014 | Merryman et al. | |
| 2005/0000585 | A1 * | 1/2005 | Betley | F16L 9/21 138/178 |
| 2005/0229504 | A1 * | 10/2005 | Bennett | E04B 1/762 52/105 |
| 2009/0104407 | A1 * | 4/2009 | Johnson | E04D 3/351 428/141 |
| 2009/0277113 | A1 * | 11/2009 | Taraba | E04D 13/0481 52/302.1 |
| 2012/0103482 | A1 * | 5/2012 | Simmons | F28B 1/06 150/165 |
| 2012/0174511 | A1 * | 7/2012 | Harding | E04D 13/076 52/302.1 |
| 2013/0036702 | A1 * | 2/2013 | Pacetti | E04H 1/1205 52/653.2 |
| 2013/0055669 | A1 * | 3/2013 | Olszewski | B32B 15/046 52/283 |
| 2013/0157048 | A1 | 6/2013 | Rudolf | |
| 2013/0161215 | A1 * | 6/2013 | Dowdy | F24F 1/58 206/320 |
| 2014/0232249 | A1 * | 8/2014 | White | F24F 1/58 312/215 |
| 2014/0260396 | A1 * | 9/2014 | Dale | F25D 13/00 62/259.1 |
| 2018/0202670 | A1 * | 7/2018 | Stanton | B65D 7/06 |
| 2018/0372260 | A1 | 12/2018 | Thomas | |
| 2019/0242122 | A1 * | 8/2019 | Ferland | E04B 2/58 |

* cited by examiner

COMPOSITE ROOF STRUCTURE FOR AIR HANDLING UNITS

CROSS-REFERENCE TO RELATED APPLICATION

This application claims the benefit of U.S. Provisional Application Ser. No. 62/815,855, entitled "COMPOSITE ROOF STRUCTURE FOR AIR HANDLING UNITS" and filed on Mar. 8, 2019, which is expressly incorporated by reference herein in its entirety.

FIELD OF THE INVENTION

The present disclosure relates generally to an apparatuses and methods for providing a cover or roof for an air handling unit, and more specifically, to a cover for an air handling unit having a waterproof composite roof structure.

BACKGROUND

An Air Handler Unit or ("AHU") is a device for regulating or circulating air as part of a larger heating, ventilating, and air-conditioning system. Frequently, AHU's are installed outdoors and may include a blower or series of blowers, heating or cooling elements, filter racks or chambers, and/or sound dampers/attenuators. AHU's may be enclosed within an AHU enclosure, which may be delivered and installed on site as a single unit or as a modular unit comprised of several units that are separated for ease of shipping and joined together during installation of the AHU on site. Frequently AHU enclosures are constructed from metal infill panels that are connected to a frame structure via fasteners.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In accordance with one aspect of the disclosure, a cover for an air handling unit enclosure is disclosed. The cover may include a panel defining a first surface, an insulating layer connected to the first surface of the panel via a first adhesive, and a waterproof membrane connected to the insulating layer via a second adhesive.

In accordance with one aspect of the disclosure, a cover for an air handling unit enclosure is disclosed. The cover may include at least a first frame rail having a first longitudinal axis that extends along a first direction and a second frame rail having second longitudinal axis that extends along a second direction. The cover may also include a composite roof including a first panel having a first panel surface and a second panel surface opposite the first panel surface, wherein the first panel is formed of a rigid material and extends from the first frame rail to the second frame rail. The composite roof may further include an insulating layer connected to the first panel via a first adhesive, and a membrane connected to the insulating layer via a second adhesive, wherein the membrane is fastened to the first frame rail and the second frame rail via at least one drip rail.

In accordance with another aspect of the disclosure, a cover system comprising a first cover and second cover that are joined to form a single air handling unit cover are disclosed. The first and second covers include, a first frame rail having a first longitudinal axis that extends along a first direction and a second frame rail having second longitudinal axis that extends along a second direction. The first and second cover further include a shipping break extending between the first frame rail and the second frame rail. Further, the first and second cover include a composite roof including a panel having a first panel surface and a second panel surface opposite the first panel surface, wherein the panel is formed of a rigid material and extends from the first frame rail to the second frame rail and ends at the shipping break. The composite roof further includes an insulating layer connected to the first panel surface via a first adhesive, and a membrane connected to the insulating layer via a second adhesive, wherein the membrane of the first and second cover system ends at the shipping break and is fastened to the first frame rail and the second frame rail via at least one drip rail. The system further includes a second membrane that covers a seam between the membrane of the first cover and the membrane of the second cover at the shipping break.

In accordance with another aspect of the disclosure, a composite roof structure for covering a frame for an air handling unit is disclosed. The composite roof structure includes a first panel having a first panel surface and a second panel surface opposite the first panel surface, wherein the first panel is formed of a rigid material. The composite roof structure further includes an insulating layer connected to the first panel via a first adhesive, and a membrane connected to the insulating layer via a second adhesive, wherein the membrane is fastened to a non-horizontal surface of the frame via at least one drip rail.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The novel features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting. Further, it will be obvious to one skilled in the art that the present invention may be practiced without these specific details. In other instances, well-known methods, procedures, and components have not been described in detail so as to not unnecessarily obscure aspects of the present invention. For purposes of the disclosure, directional terms are expressed generally with relation to a standard frame of reference when an AHU is installed and in an in-use orientation.

The present disclosure is related to an improved cover system for an Air Handling Unit ("AHU"). Known AHU enclosures may not be sufficiently insulated and/or sufficiently weather tight. Thus, the current disclosure seeks to solve one or more of the aforementioned deficiencies of the present technology by providing an AHU cover system usable with an AHU or an AHU enclosure that provides improved insulation qualities and/or improved weather sealing while decreasing the possibility of inconsistencies during the manufacturing of the AHU cover system and/or during installation of the AHU cover system on site. Specifically, due at least partially to the unique environment within an AHU, water and other environmental ingress through the enclosure may be exacerbated due to negative and/or positive pressure within the enclosure. For example, negative pressure within the AHU enclosure may cause water and other environmental contaminants to be drawn in through the various seams and fasteners in the AHU enclosure, and especially on the roof or cover of the enclosure. Further, positive pressure and/or an alternation between positive and negative pressure within the AHU enclosure can cause any seals or sealing material around seems or fasteners to break down over time, thus causing an increase in environmental ingress as a AHU or AHU enclosure ages.

In addition, inconsistent assembly of an AHU in an assembly facility and/or on site may result in inadequate sealing of an AHU from the elements. Thus, the current disclosure attempts to remedy the one or more of aforementioned deficiencies by providing an improved AHU cover that includes a composite structure that is free from possible ingress points that could potentially cause leakage. Further the disclosed AHU cover provides improved insulation qualities, resistance to adverse effects of the negative and/or positive pressures within the AHU enclosure. The current disclosure also provides techniques and structures that lead to a decrease in the possibility of inconsistencies during the manufacturing of the AHU cover system and/or during installation of the AHU cover system on site, thereby reducing leakages.

Figure 1:
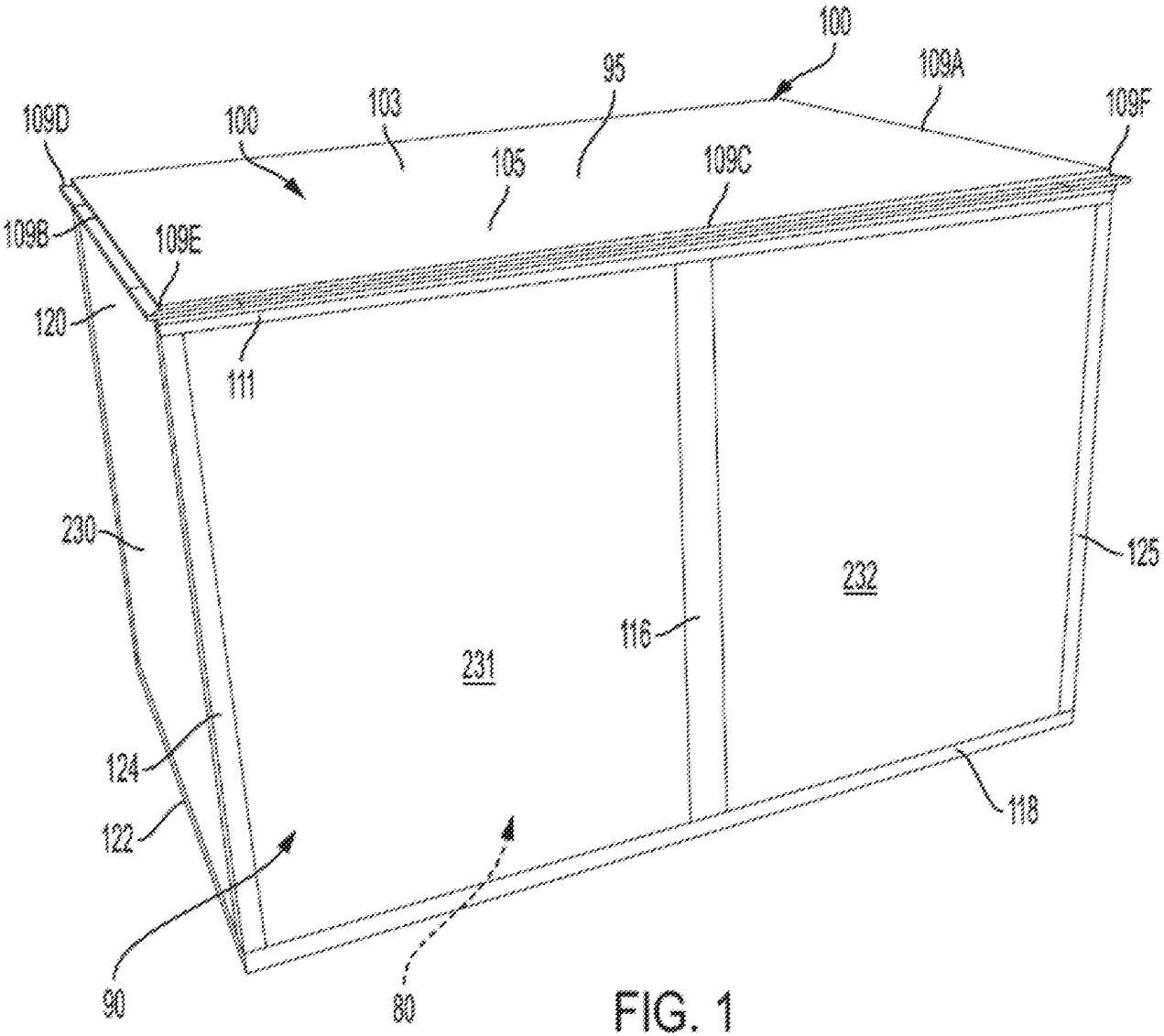
FIG. 1 is a perspective view of an air handler unit including an enclosure in accordance with one aspect of the disclosure.

With reference to FIG. 1, an AHU 80 (hidden from view in FIG. 1) within an AHU enclosure 90 is shown. It is noted that the AHU 80 and AHU enclosure 90 in FIG. 1 merely serves as an example for illustrative purposes; the current disclosure is applicable to any type of AHU and/or an AHU enclosure of any shape or size. The AHU enclosure 90 may include a frame comprised of a plurality of generally horizontal and vertical rails configured to form and support a box-like structure of the AHU enclosure 90. For example, the frame of the AHU enclosure 90 may include generally vertical frame rails, examples of which are shown by reference numbers 116, 124, and 125 sized to define at least a portion of a height of the AHU enclosure 90. The frame of the AHU enclosure 90 may further comprise a series of generally horizontal bottom frame rails, examples which are shown by reference numbers 118 and 122 sized to define a horizontal area of at least a portion of the AHU enclosure 90. The generally vertical frame rails 116, 123, and 124 may be connected to the generally horizontal bottom frame rails 118 and 122 via known fasteners such as screws, bolts, or rivets for example. The generally vertical frame rails 116, 123, and 124 may also be welded, brazed, and/or adhered to the generally horizontal bottom frame rails 118 and 122, for example. It should be noted that only a subset of the generally vertical frame rails and the generally horizontal bottom frame rails are visible in FIG. 1, but that the AHU enclosure 90 may be configured with a sufficient number of frame rails to form a generally open box-shaped structure for containing the AHU 80.

Additionally, the frame of the AHU enclosure 90 may be configured with a series of infill panels 230, 231, and 232 to enclose the sides and form walls. For example, infill panels 230, 231, and 232 may be formed of sheet metal, a plastic, or a composite material. It should be noted that only a subset of the infill panels are visible in FIG. 1, but that the AHU enclosure 90 may be configured with a sufficient number of infill panels to vertically enclose the generally open box-shaped structure of the AHU enclosure 90 for containing the AHU 80. Further, the AHU may include a bottom panel 85 (hidden from view in FIG. 1) that that may be formed of any of the aforementioned materials, for example.

Also, the frame of the AHU enclosure 90 may further include a top or cover 100 that includes a composite roof structure 95 supported at the top of the frame by a series of generally horizontal top frame rails, examples of which are shown by reference numbers 111 and 120 in FIG. 1. The generally horizontal frame rails 111 and 120 may be connected to the generally vertical frame rails 116, 123, and 124 via any of the aforementioned known fastening methods. A detailed example of the composite roof structure 95 will be explained in further detail below with reference to FIGS. 3 and 4.

Figure 3:
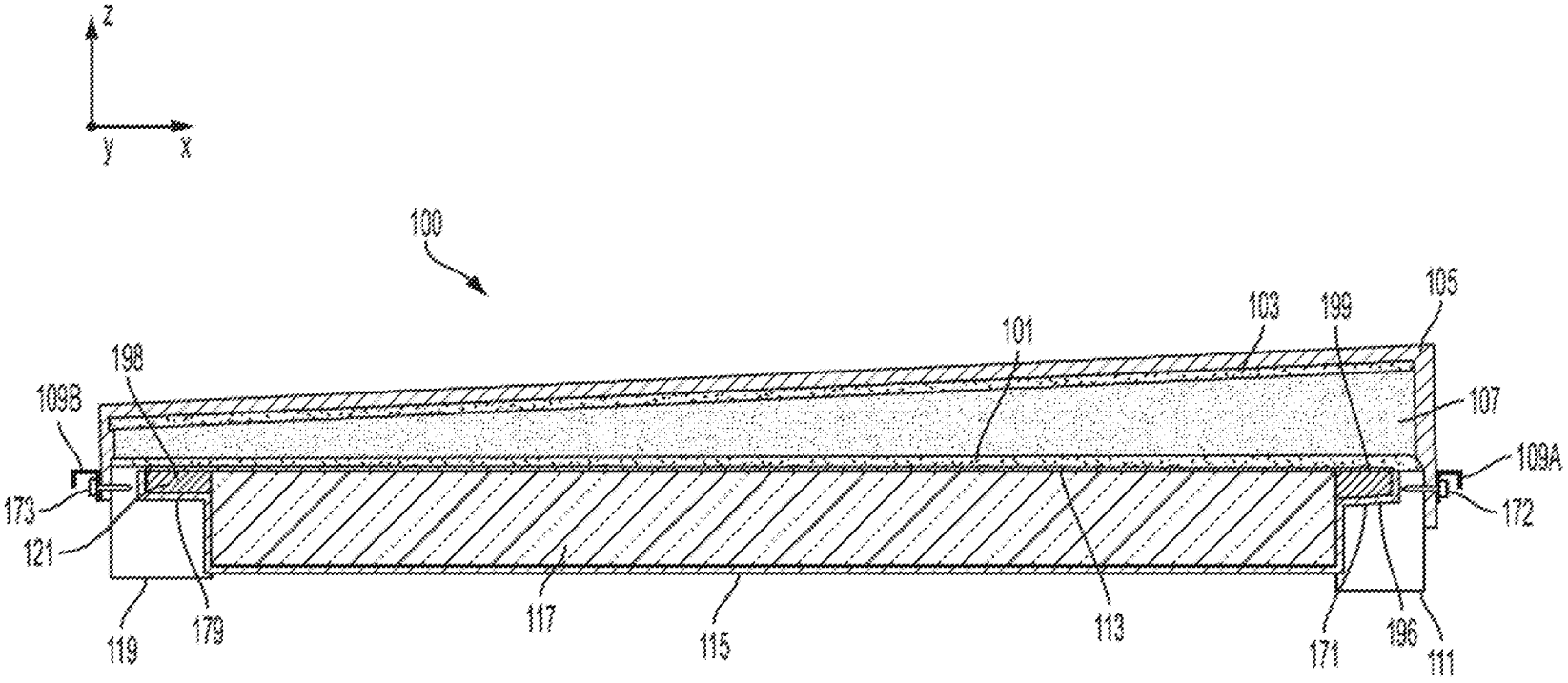
FIG. 3 is a cross-sectional side view of a cover system usable with the air handler unit enclosure of FIG. 1.
Figure 4:
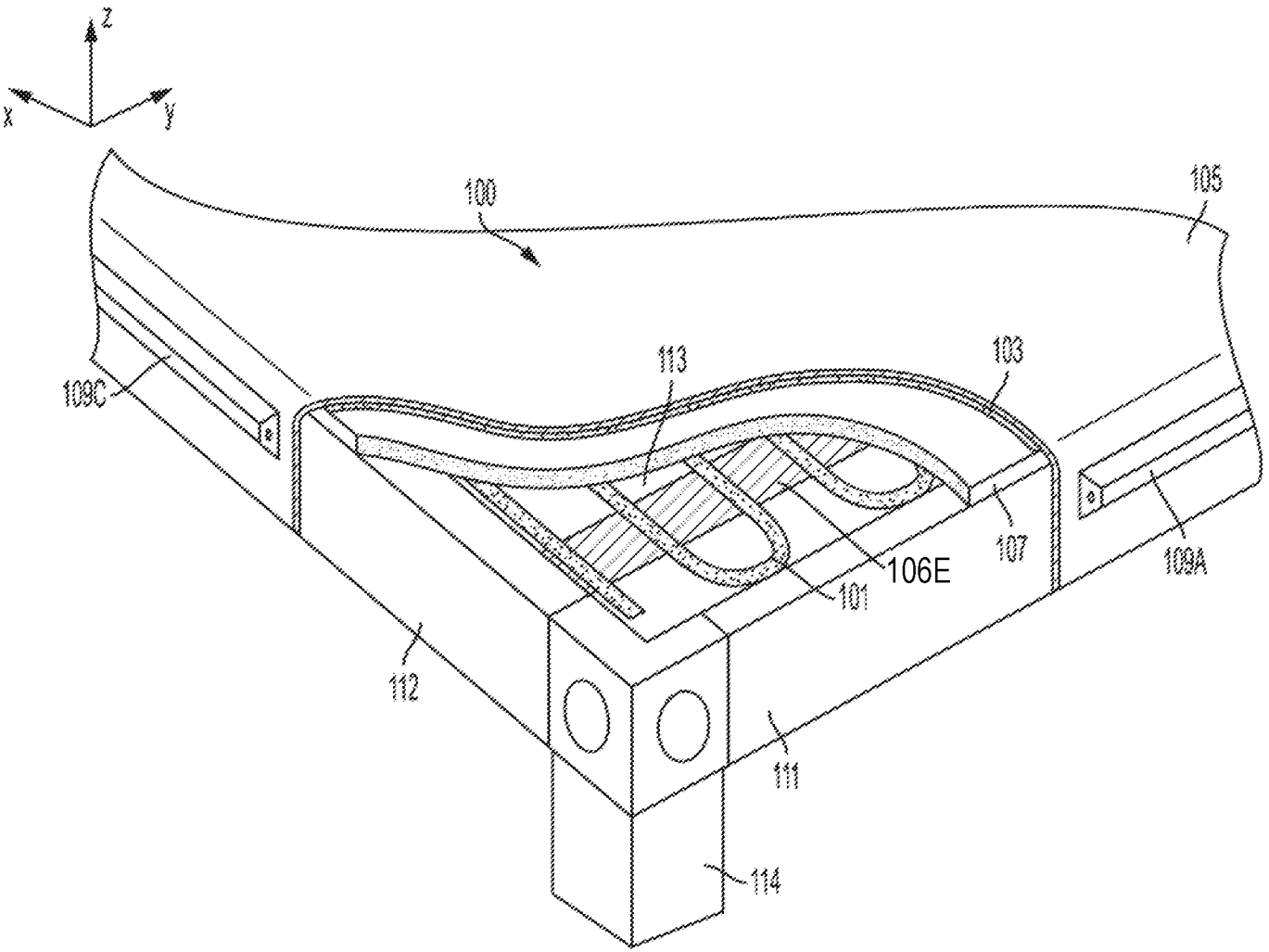
FIG. 4 is a partial cut-away perspective view of a cover system usable with the air handler unit enclosure of FIG. 1.

As shown in FIG. 1, and as discussed in further detail with relation to FIGS. 3 and 4, the composite roof structure 95 may include a membrane 105 that covers the top of the AHU enclosure 90 to provide a weather-resistance layer across the cover 100. In an aspect, the membrane 105 forms a continuous layer over the cover 100 that is free of any discontinuities on the top surface that would allow water or air or gas to penetrate through the membrane 105. To collect and re-direct any water that may run off of the membrane 105, the AHU enclosure 90 may include a single drip rail or a series of drip rails 109A-F. For example, drip rail 109A may run along the left side of the roof, drip rail 109B may run along a left side of the roof, drip rail 109C may run along a front side of the roof, and drip rails 109E and 109F may be separate corner pieces that connect the aforementioned drip rails. The one or more drip rails 109A-F may be fastened to non-horizontal sides of top frame rails 111 and 112 through the membrane 105, for example. The drip rail or series of drip rails may for example be connected to non-horizontal sides of the top frame rails 111 and 112 with the membrane 105 therebetween via a series of screws (e.g., 171 and 173 in FIG. 3) and/or a series of rivets, bolts, or any other appropriate type of fastener.

Figure 2:
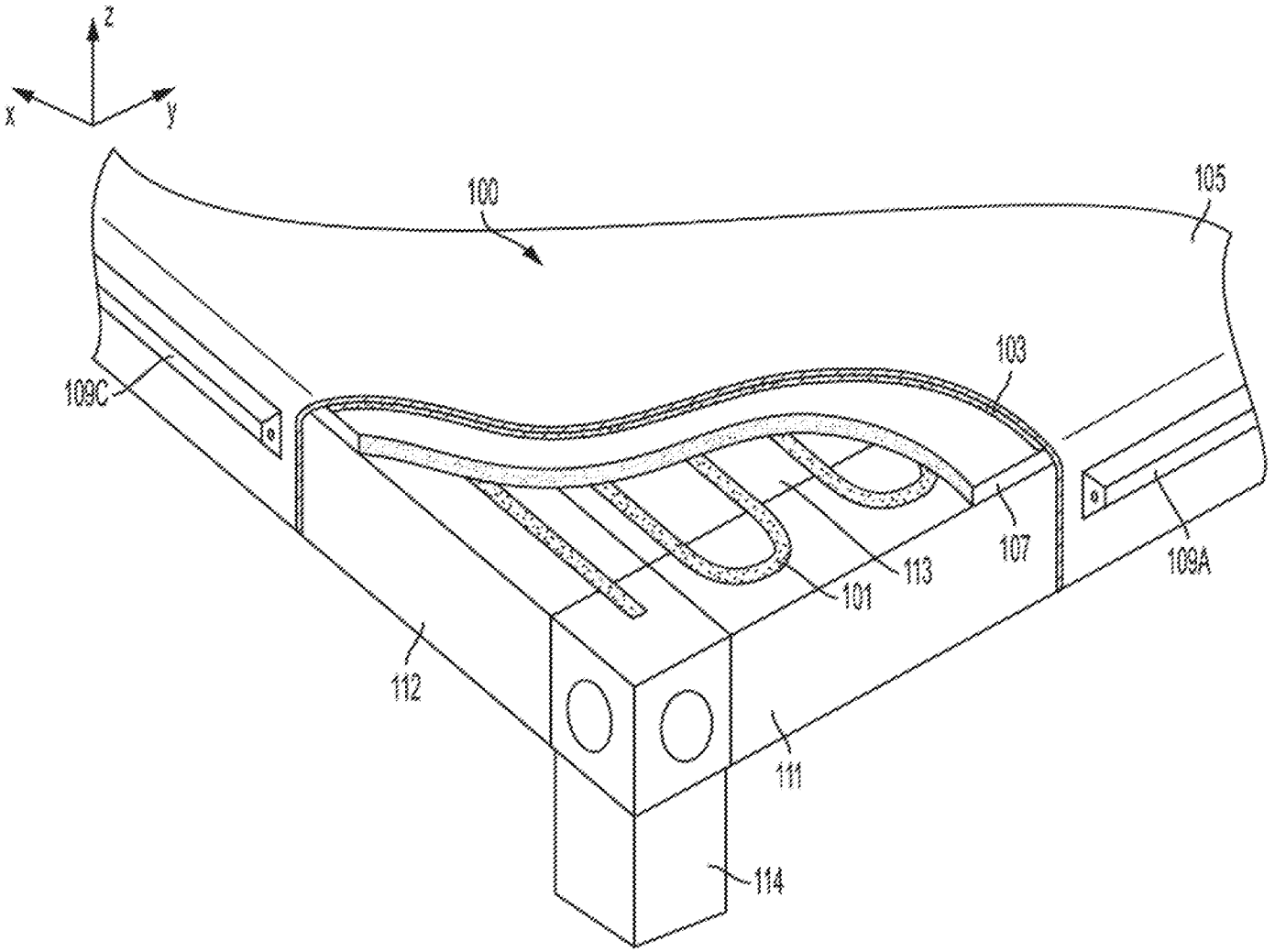
FIG. 2 is a partial cut-away perspective view of a cover system usable with the air handler unit enclosure of FIG. 1.

Referring to FIGS. 2 and 3, a more detailed example of the cover 100 usable with the AHU enclosure 90 includes a number of layers of structure and materials that define the composite roof structure 95. The cover 100 may include a series of frame rails extending along the X and Y directions as shown in FIGS. 2 and 3. While only three frame rails are shown in the partial views shown in FIGS. 2 and 3, the cover 100 may include any number of frame rails that may correspond to the shape of the AHU enclosure 90. For example, in the AHU enclosure 90 of FIG. 1, a cover may include four frame rails that are joined to form a rectangular cover, for example. Further, if desired, a number of additional frame rails may span between two substantially parallel sets of frame rails to function as cross-members and provide additional structural support to the cover.

The partial perspective view of FIG. 2 and the cross-sectional view of FIG. 3, show a first frame rail 111 (FIGS. 2 and 3), a second frame rail 119 (FIG. 3), and a third frame rail 112 (FIG. 2). The first frame rail 111, second frame rail 119, and/or the third frame rail 112 may be hollow with an outer surface formed of a metal, which may for example include aluminum, steel, or an alloy, for example. As another example, any one of or a combination of the frame rails used in the cover may for example be formed of a rigid plastic, a composite material, or any suitable material for providing structural rigidity to the AHU cover.

As shown in FIG. 2, the first frame rail 111, second frame rail 119, and/or the third frame rail 119 may be fastened to one another via fasteners (not show), or may be brazed, welded, and/or connected via an adhesive, for example. The frame may further include a vertical connection portion 114 that is configured to be connected to a vertical frame rail of the an AHU and/or an AHU enclosure. While only a single vertical connection portion 114 is shown in FIG. 2, the cover may include any number of vertical connection portions similar to or identical to the vertical connection portion 114 that are configured to connect to a respective vertical frame rail (e.g., generally vertical frame rails 116, 118, and 124 shown in FIG. 1 for example). Thus, in one aspect, the cover 100 and composite roof 95 may be assembled separately from the rest of the AHU xx and/or AHU enclosure 90, and affixed to the frame of the AHU or AHU enclosure, for example.

As shown in FIGS. 2 and 3, the cover 100 may further include a first panel 113 that spans between the first frame rail 111 (FIGS. 2 and 3), the second frame rail 119 (FIG. 3), and/or the third frame rail 112 (FIG. 2). The first panel 113 may be formed of a metal, which may for example include aluminum, steel, or an alloy, for example. As another example, the first panel 113 may be formed of a rigid plastic, a composite material, or any suitable material for providing structural rigidity to the cover 100. As shown in FIG. 3, the cover 100 may further include a second panel 115 forming a surface that is substantially parallel to a first plane formed by the first panel 113. Further, the second panel 115 may include a first interface portion 171 and a second interface portion 179 configured to be received by a respective first channel 196 in the first frame rail 111 and a second channel 121 in a second frame rail. A space 117 or cavity between the first panel 113 and the second panel 115 may be filled with an insulation and sealed via gaskets 198 and 199. The insulation in space 117 may for example be comprised of a 2-part and/or expanding polyurethane or urethane foam, for example. The combination of the first panel 113, second panel 115, and/or the insulation with in space 117 may provide improved insulation, reduce or prevent condensation on the interior of the AHU enclosure and/or provide sound attenuation or sound deadening qualities, to name a few advantages.

The cover 100 may further include the composite roof structure 95 including an insulating layer 107 connected to a first panel surface of the first panel 113. The insulating layer 107 may be, for example, adhered to the first panel 113 via a first adhesive 101. The first adhesive may be, for example, a 2-part polyurethane foam adhesive which may comprise a Polymeric Isocyanate, Diphenylmethane, Tetraflouroethance, Methylenediphenyl diisocyanate, Isocyanic acid, plymethylenepolyphenylene esther, diazetidine, Tris (2-chloro-1-methylethyl) phosphate, 1-dimethylaminoethanol, triethylenediamine and/or Polyol Amines; In another example, an Acrylic Latex adhesive may be used, for example. The insulating layer 107 may be adhered to the first panel in sheets, for example. The insulating layer may be comprised of Polyisocyanurate, extruded Polystyrene, or expanded Polystyrene, for example. As an alternative, the insulating layer 107 may be, for example, self-adhering and include a coating of adhesive on a single or both sides of the insulating layer. In one aspect of the disclosure, the insulating layer 107 may be adhered to the horizontal or substantially horizontal surfaces of the top frame rails, e.g., first frame rail 111 (FIGS. 2 and 3), second frame rail 119 (FIG. 3), and a third frame rail 112 (FIG. 2).

In one aspect of the disclosure, the insulating layer 107 of the composite roof structure 95 may be configured to provide a slope or pitch to the composite roof of the cover 100. For example, as shown in FIG. 3, the insulating layer 107 may be thicker at a location proximal to the first frame rail 111 and may be thinner at a location proximal to the second frame rail 119. In one aspect of the disclosure, the insulating layer 107 may increase in thickness from the first frame rail 111 to the second frame rail 119 so as to provide a rise and run of ⅛ of an inch per 1 inch. In another alternative aspect the insulating layer 107 may be thicker at a central point between the first frame rail 111 and the second frame rail 119 and may be thinner at a location proximal to the second frame rail 119 and at a location proximal to the first frame rail 111. The insulating layer 107 may provide improved insulation, prevent the pooling of water by providing a sloped surface, and may help to dissipate the effects of any negative and/or positive pressure within the AHU enclosure 90 though any seams, holes, and/or openings in the underlying cover structure.

The composite roof structure 95 of cover 100 may further include the membrane 105, which may be waterproof or comprise a waterproof or water-resistant layer. In one example the membrane may be fastened to the aforementioned insulating layer 107 via a second adhesive 103 and/or adhesive layer. The second adhesive 103 may for example be a 2-part adhesive that comprises a Polymeric Isocyanate and Polyol Amines, or an Acrylic Latex, for example. The membrane 105 may for example be self-adhering and include coating of adhesive on a single side of the membrane facing the insulating layer 107. The membrane 105 may for example comprise a Thermoplastic Polyolefin, an Ethylene Propylene Diene Terpolymer, or a Polyvinyl Chloride. In one example, the membrane 105 may be fleece-backed to provide additional surface area for adherence of the second adhesive and/or adhesive layer 103. The membrane 105 may cover the top of the composite roof, the sides of the insulating layer 107, and/or a portion of the frame rails of the cover 100. For example, as shown in FIGS. 2 and 3, the membrane 105 may extend to the first frame rail 111 (FIGS. 2 and 3), a second frame rail 119 (FIG. 3), and a third frame rail 112 (FIG. 2), thus eliminating any possible water or environmental ingress though seams or openings in the top surface of cover 100.

Figure 5:
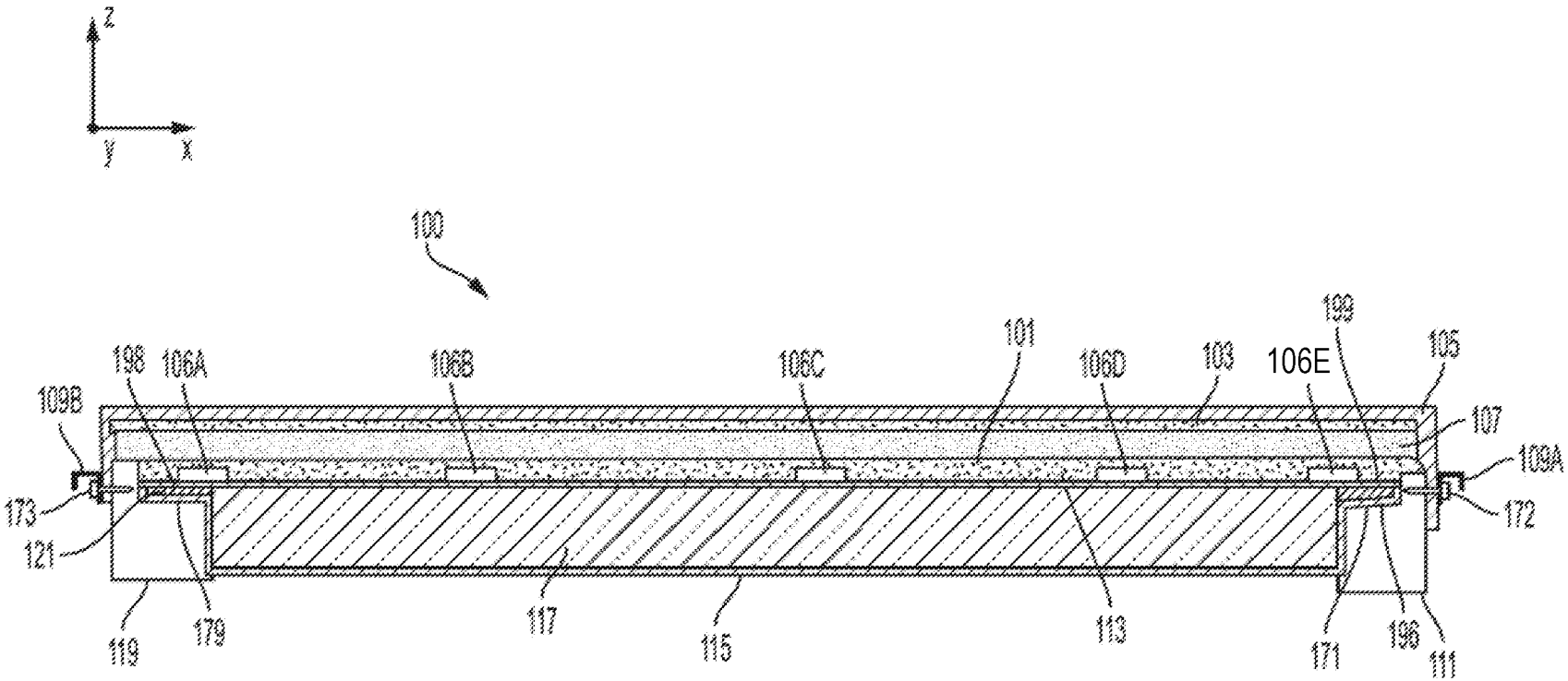
FIG. 5 is a cross-sectional side view of a cover system usable with the air handler unit enclosure of FIG. 1.
Figure 6:
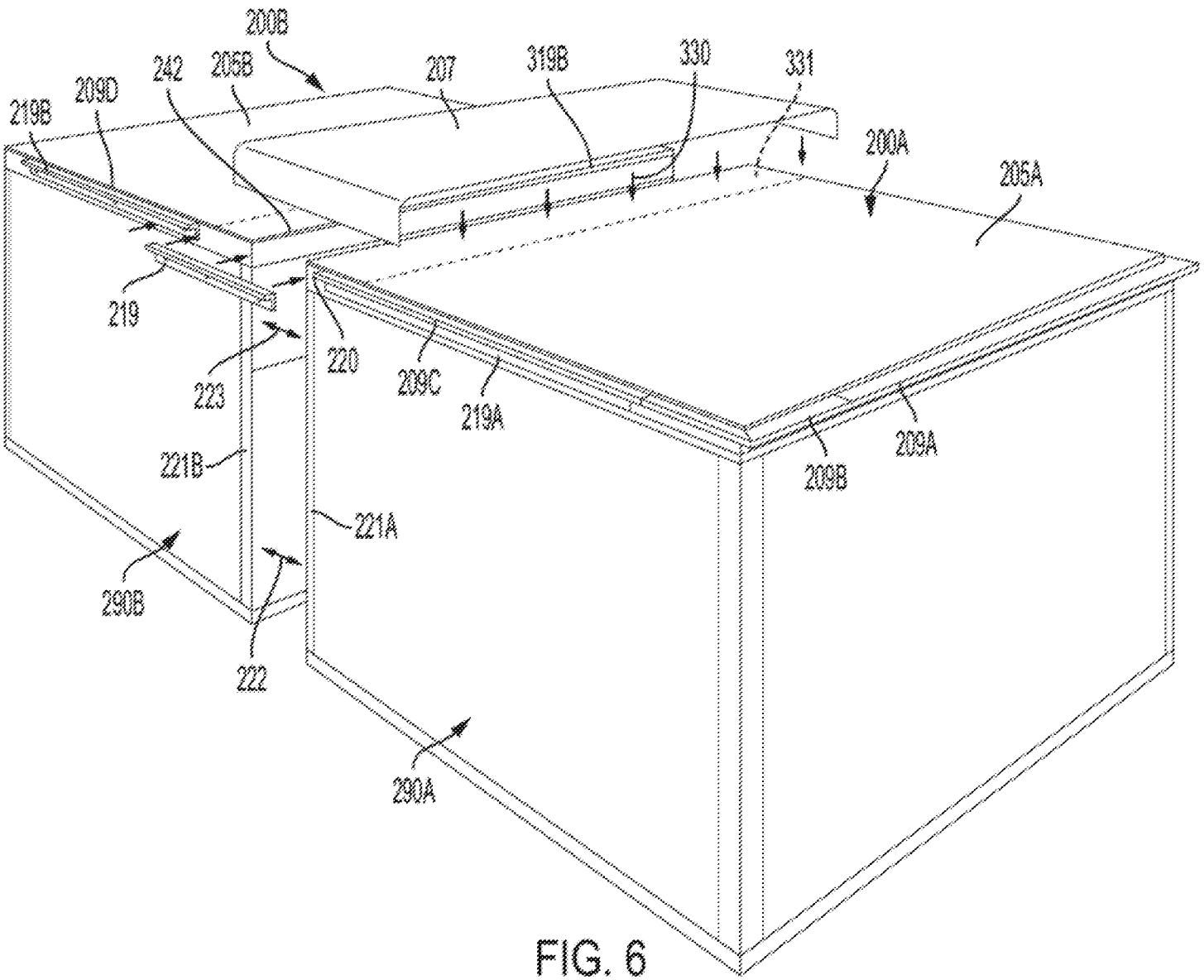
FIG. 6 is a perspective view of an air handler system usable with the cover system of the current disclosure including multiple modular units that are connectable on site.

As shown in FIGS. 2 and 3, a portion of the membrane 105 that extends to the frame rails, e.g., the first frame rail 111 (FIGS. 2 and 3), a second frame rail 119 (FIG. 3), and a third frame rail 112 (FIG. 2), may be fastened to a substantially vertical side of each respective top frame rail via a series of drip rails 109A (FIGS. 1 and 2), 109B (FIG. 3), and 109C (FIG. 2). For example, the drip rails 109A-C may be fastened to the substantially vertical sides of top frame rails 111 and 112 through membrane 105, for example. The drip rail or series of drip rails may for example be connected to vertical sides of the top frame rails 111 and 112 with the membrane 105 therebetween via a series of screws (e.g., 171 and 173 in FIG. 3) and/or a series of rivets, bolts, or any other appropriate type of fastener. Further, as shown in FIG. 1, the drip rail may include drip rail corner pieces 109D, 109E, and 109F at the junctions of drip rails 109A, 109B, and 109C, for example. It is noted that while several individual drip rails that are joined together are shown in FIGS. 1-4, as an alternative the drip rail may for example be comprised of a single drip rail that is formed from a single piece of material, for example. By providing a drip rail to fasten membrane 105 to the frame of the cover structure, the membrane is securely fastened to the structure thus decreasing the possibility of the membrane separating from the insulating layer 107, for example. Further the drip rail provides an additional measure to prevent ingress of water into the AHU enclosure 90 by directing water flow away from the sides of the unit. In addition, the aforementioned structure provides a decrease in the possibility of inconstancies during the manufacturing of the AHU cover system and/or during installation of the AHU cover system on site by removing possible water ingress points from the horizontal surfaces of the AHU cover that would need to be sealed by a technician, for example. FIGS. 4 and 5 show a roof structure with a number of elements that are similar or identical to those outlined with reference to FIGS. 1-3 above. As shown in FIGS. 4 and 5, the composite roof structure may further include a series of support members 106A-E provided between a first panel 113 and insulating layer 107. Each one of the series of support members 106A-E may be formed as an elongated strip that extends along the Y direction in FIGS. 4 and 5, for example. The support members may be formed of any rigid and/or semi-rigid material and may provide support to the insulating layer and/or provide support at a seem between a plurality of insulating layers if the insulating layer is comprised of multiple insulating layers, for example. The support members may be formed of a metallic material such as steel, aluminum, or alloy; may be formed of a foam; and/or may be formed of a composite or plastic material for example. Further, the support members 106A-E may be adhered to the first panel 113 via a separate adhesive prior to application of the first adhesive layer 113 and/or may be placed on the first panel 113 and prior to application of the first adhesive layer 113 and adhered to the first panel 113 and the insulating layer via the first adhesive layer 113. The support members 106A-E, may be arranged such that the major axis of each of the plurality of support members extends along a sloping direction of the insulating layer 107 (e.g., along an x axis direction in FIG. 3). In another aspect, the support members 106A-E may be arranged such that the major axis of each of the plurality of support members extends a transverse direction with respect to the sloping direction of the insulating layer 107. In another aspect, the support members 106A-E may be arranged such that the major axis of each of the plurality of support members extends diagonally or at an angle with respect to any one of the frame rails, e.g., first frame rail 111 (FIGS. 2 and 3), second frame rail 119 (FIG. 3), and/or the third frame rail 112 (FIG. 2). In yet another aspect, the support member may be provided as a solid sheet instead of as a series of elongated support members as shown in FIGS. 4 and 5. Referring to FIG. 6, one example of the AHU enclosure the may include multiple AHU enclosures and covers connectable to one another at shipping breaks. Shipping breaks are provided when a AHU or AHU enclosure is too large to transport as a single unit. Thus an AHU and/or AHU enclosure is delivered as several separate modules that include shipping breaks that are joined on site. It is noted that a number of the features and advantages mentioned above with respect to a single AHU cover are likewise also applicable to an AHU and/or AHU enclosure, thus a number of details that have been described and are applicable to the example AHU and/or AHU enclosure of FIG. 6 are omitted.

As shown in FIG. 6, an example of the multiple, connectable AHU enclosures may include a first AHU enclosure 290A and a second AHU enclosure 290B separated by a shipping break at borders 221A and 221B. The borders 221A and 221B may be at or defined by generally vertical frame rails similar to the generally vertical frame rails 116, 123, and 124 in FIG. 1. Once the first AHU enclosure 290A and the second AHU enclosure 290B is delivered to an installation site, boarders 221A and 221B are joined in a direction denoted by arrow 222. Each of the AHU enclosures 290A and 290B may include covers 200A and 200B respectively. Each cover 200A and 200B may comprise the composite roof structure 95 discussed above with relation to FIGS. 1-3. Accordingly, the first cover 200A may include a membrane 205A and a second cover may include a membrane 205B. Prior to on-site assembly, a composite roof structure 95 as described above with relation to FIGS. 1-4 may be installed on each of the first cover 200A and the second cover 200B. As one example, a membrane 205A of the first cover 200A may be connected to a first frame 219A a second frame (hidden from view in FIG. 6) and a third frame 211A via drip rails 209A 209B, and 209C for example.

In one aspect, in order to allow the assembly and subsequent sealing of the shipping break, the membrane 205A of the first cover 200A and the membrane of the second cover 200B may not be connected to a frame rail via a drip rail at a shipping break. For example, as shown in FIG. 6, the membrane 205B of the second cover 200B ends at a shipping break border 319B. While hidden from view in FIG. 6, a similar shipping break border may be provided on the first cover 200A. Further, drip rail 209C may be configured to not span the entire length of a first frame 219A, thus leaving a gap between the border 221A of the shipping break and the drip rail 209C. Similarly, a drip rail 209D of first frame 219B of the second cover 200B may not span the entire length of frame 219B, thus leaving a gap between the border 221B of the shipping break. While hidden from view in FIG. 6, a similar configuration may be disposed on an opposite side of the first cover 200A and the second cover 200B, for example.

Once the first AHU enclosure 290A an second AHU enclosure 290B are joined in a direction denoted by arrow 222, a second membrane 207 may be provided to overlap a portion (e.g., reference 331) of the membrane of the first cover 200A, and to overlap a similar portion of the second cover 200B. The second membrane 207 may comprise a Thermoplastic Polyolefin, an Ethylene Propylene Diene Terpolymer, or a Polyvinyl Chloride to name some examples. Further the second membrane 207 may be adhered to membranes 205A and 205B via an adhesive, which may for example include a 2-part adhesive that comprises a Polymeric Isocyanate and Polyol Amines. In another aspect, the adhesive may for example be a peal-and-stick adhesive provided on one side of the second membrane and configured to permanently adhere to membranes 205A and 205B.

Once the second membrane 207 is adhered to membranes 205A and 205B, the second membrane 207 may be fastened to the first frame 219A of the first cover 200A and the first frame 219B of the second cover 200B via a connector drip rail 219 that spans the shipping break. While hidden from view in FIG. 6, a similar or identical connector drip rail may be used to fasten the second membrane 207 to an opposite side of the AHU enclosure. Accordingly, the current disclosure also provides similar advantages to those expressed above for AHU and/or AHU enclosures that are large enough to require shipping breaks for transportation. Further, the current disclosure provides a simple system for weatherproofing shipping breaks of an AHU and/or AHU enclosures when such a system in installed on site, thus decreasing the possibility of inconstancies during installation of the system on site.

The foregoing description of various aspects and examples have been presented for purposes of illustration and description. It is not intended to be exhaustive nor to limit the disclosure to the forms described. The embodiment(s) illustrated in the figures can, in some instances, be understood to be shown to scale for illustrative purposes. Numerous modifications are possible in light of the above teachings, including a combination of the above-mentioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

What is claimed is:

1. A cover for an air handling unit comprising:

a first panel defining a first panel surface and a second panel surface opposite the first panel surface;

a second panel facing the second panel surface of the first panel and separated from the first panel by a gap;

an insulating layer connected to the first panel surface of the first panel via a first adhesive;

a waterproof membrane connected to the insulating layer via a second adhesive;

a first frame rail having a first longitudinal axis that extends along a first direction, wherein the first frame rail comprises a first surface that intersects a second surface of the first frame rail at a first angle, wherein the insulating layer is connected to the first surface via the first adhesive, and wherein the waterproof membrane is connected to the second surface via a drip rail; and a second frame rail having a second longitudinal axis that extends along a second direction, wherein the second frame rail comprises a third surface that intersects a fourth surface of the second frame rail at a second angle, wherein the insulating layer is connected to the third surface via the first adhesive, wherein the waterproof membrane is connected to the fourth surface via the drip rail, and wherein the first panel extends from the first frame rail to the second frame rail.

2. The cover of claim 1, wherein the waterproof membrane is fastened to the first frame rail and the second frame rail.

3. The cover of claim 1, wherein the first adhesive comprises a first chemical or material composition, the second adhesive comprises a second chemical or material composition, and wherein the first chemical or material composition is the same as the second chemical or material composition.

4. A cover for an air handling unit, comprising:

a first frame rail having a first longitudinal axis that extends along a first direction;

a second frame rail having a second longitudinal axis that extends along a second direction; and a composite roof including:

a first panel having a first panel surface and a second panel surface opposite the first panel surface, wherein the first panel is formed of a rigid material and extends from the first frame rail to the second frame rail;

an insulating layer connected to the first panel via a first adhesive;

a membrane connected to the insulating layer via a second adhesive, wherein the membrane is fastened to the first frame rail and the second frame rail via a drip rail; and a second panel, wherein a portion of the second panel is substantially parallel to and spaced from the first panel with an insulating material therebetween.

5. The cover of claim 4, wherein the insulating layer is thicker at a first location proximal to the first frame rail than at a second location proximal to the second frame rail.

6. The cover of claim 4, wherein the first frame rail has a first surface along the first direction and a second non-horizontal surface that extends along the first direction, wherein the first surface and the second non-horizontal surface fall within a respective first plane and a second plane that intersect one another at a first angle, wherein the insulating layer is connected to the first surface via the first adhesive and the membrane is connected to the second non-horizontal surface via the drip rail; and the second frame rail has a third surface extending along the second direction and a fourth non-horizontal surface that extends along the second direction wherein the third surface and the non-horizontal fourth surface fall within a respective third plane and a fourth plane that intersect one another at a second angle, wherein the insulating layer is connected to the third surface via the first adhesive and the membrane is connected to the fourth non-horizontal surface via the drip rail.

7. The cover of claim 4, wherein the membrane comprises a Thermoplastic Polyolefin, an Ethylene Propylene Diene Terpolymer, or a Polyvinyl Chloride.

8. The cover of claim 4, wherein the first adhesive comprises a first chemical or material composition, the second adhesive comprises a second chemical or material composition, and wherein the first chemical or material composition is the same as the second chemical or material composition.

9. The cover of claim 4, wherein the insulating layer comprises a Polyisocyanurate, an extruded Polystyrene, or an expanded Polystyrene.

10. The cover of claim 4, wherein one of the first and second adhesive is a 2-part adhesive that comprises a Polymeric Isocyanate and Polyol Amines.

11. A cover system for an air handing unit, comprising:

a first cover and a second cover that are joined to form a single air handling unit cover, wherein each of the first cover and the second cover includes:

a first frame rail having a first longitudinal axis that extends along a first direction;

a second frame rail having a second longitudinal axis that extends along a second direction;

a shipping break extending between the first frame rail and the second frame rail; and a composite roof including:

a panel having a first panel surface and a second panel surface opposite the first panel surface, wherein the panel is formed of a rigid material and extends from the first frame rail to the second frame rail and ends at the shipping break;

an insulating layer connected to the first panel surface via a first adhesive; and a membrane connected to the insulating layer via a second adhesive, wherein the membrane ends at the shipping break and is fastened to the first frame rail and the second frame rail via a drip rail, wherein a second membrane covers a seam between the membrane of the first cover and the membrane of the second cover at the shipping break.

12. The cover system of claim 11, wherein the second membrane is connected to the membrane of the first cover and the membrane of the second cover via a third adhesive.

13. The cover system of claim 12, wherein the third adhesive is a peal-and-stick adhesive provided on one side of the second membrane.

14. The cover system of claim 12, wherein the second membrane is fastened to the first frame rail of the first cover and to the first frame rail of the second cover via a first connector drip rail that spans the shipping break and wherein the second membrane is fastened to the second frame rail of the first cover and the second frame rail of the second cover via a second connector drip rail that spans the shipping break.

15. The cover system of claim 12, wherein the insulating layer of each of the first cover and the second cover is thicker at a first location proximal to the first frame rail than at a second location proximal to the second frame rail.

16. The cover system of claim 12, wherein the insulating layer of the first cover is thickest at the shipping break and thinner at a first location distal from the shipping break, and the insulating layer of the second cover is thinnest at the shipping break and thicker at a second location distal from the shipping break.

17. The cover system of claim 12, wherein the membrane comprises a Thermoplastic Polyolefin, an Ethylene Propylene Diene Terpolymer, or a Polyvinyl Chloride.

18. The cover system of claim 12, wherein the first and second adhesive are the same.

19. The cover system of claim 12, wherein the insulating layer comprises a Polyisocyanurate, an extruded Polystyrene, or an expanded Polystyrene.

20. The cover system of claim 12, wherein one of the first and second adhesive is a 2-part adhesive that comprises a Polymeric Isocyanate and Polyol Amines.

21. A composite roof structure for covering a frame of an air handling unit, the composite roof structure having a cross-section comprising:

a first panel having a first panel surface and a second panel surface opposite the first panel surface, wherein the first panel is formed of a rigid material;

an insulating layer connected to the first panel surface via a first adhesive;

a membrane connected to the insulating layer via a second adhesive, wherein the membrane is fastened to a first surface of the frame via a drip rail;

a second panel facing the second panel surface of the first panel; and an additional insulating layer disposed between the first panel and the second panel.

22. The composite roof structure of claim 21, wherein the insulating layer is thicker at a first end of the first panel and thinner at a second end of the first panel.

23. The composite roof structure of claim 21, wherein the frame comprises a second surface that intersects the first surface at an angle, wherein the insulating layer is connected to the second surface via the first adhesive.

24. The cover of claim 1, wherein the drip rail connects the waterproof membrane to the second surface via one or more fasteners extending through the drip rail and the waterproof membrane and into the second surface.

25. The composite roof structure of claim 21, wherein the drip rail fastens the membrane to the first surface of the frame via one or more fasteners extending through the drip rail and the membrane and into the first surface.

* * * * *